US005284493A

United States Patent [19]

Baillargeon et al.

[11] Patent Number: 5,284,493

[45] Date of Patent: * Feb. 8, 1994

[54] MULTIFUNCTIONAL ADDITIVES TO IMPROVE THE LOW-TEMPERATURE PROPERTIES OF DISTILLATE FUELS AND COMPOSITIONS CONTAINING SAME

[75] Inventors: David J. Baillargeon, Cherry Hill; Angeline B. Cardis, Florence; Dale B. Heck, West Deptford; Susan W. Johnson, Marmora, all of N.J.

[73] Assignee: Mobil Oil Corporation, Fairfax, Va.

[ * ] Notice: The portion of the term of this patent subsequent to Mar. 26, 2008 has been disclaimed.

[21] Appl. No.: 976,702

[22] Filed: Nov. 16, 1992

Related U.S. Application Data

[63] Continuation of Ser. No. 627,790, Dec. 14, 1990.

[51] Int. Cl.[5] ..... C10L 1/14

[52] U.S. Cl. ..... 44/331; 44/386; 44/391; 44/405; 560/88; 560/89

[58] Field of Search ..... 44/331, 386, 391, 405; 560/88, 89

[56] References Cited

U.S. PATENT DOCUMENTS

| | | | |
|---|---|---|---|
| 3,502,712 | 3/1970 | DeBrunner | 260/475 |
| 3,530,074 | 9/1970 | DeBrunner | 252/184 |
| 5,002,589 | 3/1991 | Baillargeon et al. | 44/399 |
| 5,039,306 | 8/1991 | Baillargeon et al. | 44/331 |
| 5,039,309 | 8/1991 | Baillargeon et al. | 44/331 |

*Primary Examiner*—Prince Willis, Jr.
*Assistant Examiner*—M. Nuzzolillo
*Attorney, Agent, or Firm*—Alexander J. McKillop; Malcolm D. Keen; Howard M. Flournoy

[57] ABSTRACT

The reaction products of (1) anhydrides and/or polyacids and (2) aminoalcohols or aminoalcohols/amides with long chain hydrocarbyl groups attached improve the low-temperature properties of distillate fuel when added thereto.

34 Claims, No Drawings

MULTIFUNCTIONAL ADDITIVES TO IMPROVE THE LOW-TEMPERATURE PROPERTIES OF DISTILLATE FUELS AND COMPOSITIONS CONTAINING SAME

This is a continuation of copending application Ser. No. 07/627,790, filed on Dec. 14, 1990, now abandoned.

BACKGROUND OF THE INVENTION

This application is directed to novel ester and ester/amide additive reaction products of (1) anhydrides and/or poly-acids and (2) hydrocarbyl aminoalcohols or aminoalcohols/amines which are useful for improving the low-temperature properties of distillate fuels, and fuel compositions containing same.

Traditionally, the low-temperature properties of distillate fuels have been improved by the addition of kerosene, sometimes in very large amounts (5–70 wt. %). The kerosene dilutes the wax in the fuel, i.e. lowers the overall weight fraction of wax, and thereby lowers the cloud point, filterability temperature, and pour point simultaneously. The additives of this invention effectively lower both the cloud point and CFPP (Cold Filter Plugging Point) of distillate fuel without any appreciable dilution of the wax component of the fuel.

Other additives known in the art have been used in lieu of kerosene to improve the low-temperature properties of distillate fuels. Many such additives are polyolefin materials with pendent fatty hydrocarbon groups. These additives are limited in their range of activity, however; most improve fuel properties by lowering the pour point and/or filterability temperature. These same additives have little or no effect on the cloud point of the fuel. The additives of this invention effectively lower distillate fuel cloud point, and thus provide improved low-temperature fuel properties, and offer a unique and useful advantage over known distillate fuel additives. Accordingly, no art is known to applicants which teaches or suggests the additive products and compositions of this invention.

SUMMARY OF THE INVENTION

The novel esters and ester/amides prepared in accordance with this invention have been found to be surprisingly active wax crystal modifier additives for distillate fuels. Distillate fuel compositions containing, for example, ≦0.1 wt. % of such additives demonstrate significantly improved low-temperature flow properties, i.e. lower cloud point and lower CFPP filterability temperature.

These additives are ester or ester/amide products which have core-pendant group (star-like) structures derived from the reaction of an anhydride-containing or carboxylic acid-containing "core" with the following "pendant groups:" (1) an aminoalcohol, the product of an amine and an epoxide, or (2) a combination of an aminoalcohol and a secondary amine. The aminoalcohols, may also encompass a combination of two or more different aminoalcohols.

Thus a primary object of this invention is to improve the low-temperature flow properties of distillate fuels and thereby provide improved fuel compositions. These new additives are especially effective in lowering the cloud point of distillate fuels, and thus improve the low-temperature flow properties of such fuels without the use of any light hydrocarbon diluent, such as kerosene. In addition, the filterability properties are improved as demonstrated by lower CFPP temperatures. Thus, the additives of this invention demonstrate multifunctional activity in distillate fuels.

The additives in accordance with the invention are unique. Also, additive concentrates and fuel compositions containing such additives are unique. Similarly, the processes for making these additives, additive concentrates, and fuel compositions are unique.

DESCRIPTION OF PREFERRED EMBODIMENTS

The additives of this invention have core-pendant group (star-like) structures. These additives are reaction products obtained by combining the core structure and the pendant group(s) in differing ratios using standard techniques for esterification/amidifcation. These wax crystal modifiers which are highly effective in lowering cloud point are generally characterized by the following structural features:

(a) a compact "core" which forces close proximity of the pendant groups (pairs of adjacent carboxyl groups where the pendant groups are attached are generally separated by four or fewer atoms);

(b) a pendant group containing a high density of paraffin chains; and (c) a pendant group structured in such a way as to allow facile parallel orientation of the attached paraffin chains.

Suitable pendant groups are alcohols and amines with some combination of linear hydrocarbyl groups attached. The pendant groups include (1) aminoalcohols, derived from a secondary fatty amine capped with an epoxide, and (2) combinations of the aminoalcohol from (1) and a secondary amine. The aminoalcohol, above, may include one or more different aminoalcohols. The aminoalcohols of this invention satisfy the general conditions (b) and (c), above, particularly well. The general preparation of the aminoalcohols of this invention from an epoxide and a secondary amine is illustrated below:

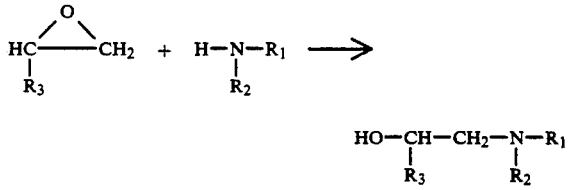

Where:

$R_1$, $R_3 = C_8$–$C_{50}$ linear hydrocarbyl groups, either saturated or unsaturated.

$R_2 = R_1$, or $C_1$–$C_{100}$ hydrocarbyl

Suitable core structures contain two or more reactive carboxyl groups (anhydrides, acids, or acid equivalents). These structures include, but are not limited to, aromatic, alicyclic, aralkyl, alkylaryl, and alkyl hydrocarbons, as well as their corresponding heteroatom-containing analogues.

The additives of this invention are the reaction products of the "core" and "pendant group" precursors, and a range of reactant stoichiometries may be used. However, each additive requires one "core" derivatized with at least one aminoalcohol "pendant group;" any additional pendant groups may be either aminoalcohols or amines and may be added up to the limit of available reactive carboxyl groups in the core structure.

Additives of this invention may be grouped into categories based on distinct structural and compositional differences, described below. Preparation of selected additives are given in EXAMPLES 1-5. Additive compositions and their respective performance for cloud point and CFPP are given in TABLES 1-3.

Category A: Aromatic "Core" (TABLE 1)

The preferred aminoalcohol, Entry 1, used in the synthesis of the additives of this invention, has low cloud point and CFPP activity by itself. Successful additives may be prepared from aromatic cores which are difunctional (e.g. phthalic anhydride, Entry 7), trifunctional (e.g trimesic acid, Entries 3-6; trimellitic anhydride, Entries 14-16), or tetrafunctional (e.g. tetrahydrofuran tetracarboxylic dianhydride, Entry 11). The requirement that one pendant group must be an appropriate aminoalcohol is demonstrated by the amide analogues of PMDA (pyromellitic dianhydride; Entries 2, 12) and BTDA (benzophenonetetracarboxylic dianhydride; Entry 13); such analogues prepared without any aminoalcohol do not attain high cloud point activity. The requirement that the core functional groups allow the pendant groups to approach one another (i.e. carboxyl groups separated by no more that four atoms) is best demonstrated by the dicarboxyl benzene series (Entries 7-9) and by 2,6-naphthalene dicarboxylic acid (Entry 10). As the product ester groups move further apart, from two-carbon separation (Entry 7) to three-carbon separation (Entry 8) to four- and six- carbon separation (Entries 9 and 10), the additive's cloud point activity falls from high activity to low activity.

A typical synthesis is illustrated by the preparation of the trimesate material (Entry 3) in EXAMPLE 1.

Category B: Bicyclic and Alicyclic "Cores" (TABLE 2)

Successful additives may be prepared from non-aromatic but relatively structurally rigid cores, such as bicyclics or alicyclics. Bicyclic cores may be difunctional (e.g. norbornene dicarboxylic anhydride, Entry 17; camphoric acid, Entry 19), or tetrafunctional (e.g bicyclooctene tetracarboxylic dianhydride, Entry 18). An example of a suitable alicyclic core is cyclohexane dicarboxylic anhydride (Entry 20).

A typical synthesis is illustrated by the preparation of the norbornene diester (Entry 17) in EXAMPLE 2.

Category C: Alkyl "Cores" (TABLE 2)

Successful additives may be prepared from non-rigid cores if the density of reactive groups is sufficiently high, i.e. if the core molecule is sufficiently small. For example, additives with good cloud point activity were derived from butyl citrate (Entry 21), and from maleic anhydride (Entry 22). By comparison, additives derived from large non-rigid alkyl cores such as dimer acid (Hystrene 3695, Entry 23) and trimer acid (Hystrene 5460, 60:40 mixture of trimer:dimer acids, Entry 24) offer little substantial cloud point activity.

A typical synthesis is illustrated by the preparation of the maleate ester (Entry 22) in EXAMPLE 3.

Category D: Multifunctional, Post-Reacted Additives (TABLE 3)

Multifunctional additives may be prepared from the cloud point additives of this invention, and may have advantages as ashless dispersants, detergents, antirust agents, antiwear agents, etc. Multifunctionality may be introduced into the core/pendant group additives whenever a suitably reactive group is available for post-reaction with a secondary chemical agent.

In one approach, for example, judicious choice of core/pendant group stoichiometry may leave residual acid and/or anhydride groups available for post-reaction. This strategy was demonstrated with PMDA and BTDA derivatives (Entries 25-30, and 33-34) where only half of the available carboxyl groups were esterified with the aminoalcohol from Armeen 2HT/Vikolox 18, i.e. di(hydrogenated tallow) amine/1,2-epoxy-$C_{18}$ alkane. Such materials were then post-reacted with (a) mono-capped polypropylene glycol (e.g. UCON LB-1145, average MW=2200, Entry 25-26), (b) amino-polyethers (e.g. Jeffamine M-600, mono-capped amine-terminated polypropylene oxide, MW=600, Entries 27-28; Surfonamine MNPA-380 amino polyether-capped nonylphenol, Entries 29-30), and (c) polyethyleneamine (e.g. E-100, Entries 33-34). Entries 31-32 again demonstrate the low additive activities attained when the aminoalcohol component of the composition (in this case the adduct of Armeen 2HT/Vikolox 18) is absent.

In another approach, the secondary reactive functionality is chosen so as to be unreactive in the initial esterification process used to prepare the cloud point additive. For example (Entries 35-36), maleic anhydride was esterified with the Armeen 2HT/Vikolox 18 aminoalcohol, and the remaining activated olefin was post-reacted via addition of the polyethyleneamine TEPA (tetraethylenepentaamine).

Suitable amines, as indicated above, are secondary amines with at least one long-chain hydrocarbyl group. Highly useful secondary amines include but are not limited to di(hydrogenated tallow) amine, ditallow amine, dioctadecylamine, methyloctadecylamine and the like.

The reactions can be carried out under widely varying conditions which are not believed to be critical. The reaction temperatures can vary from about 100 to 250° C. or reflux, preferably 120° to 200° C., under ambient or autogenous pressure. However slightly higher pressures may be used if desired. The temperatures chosen will depend upon for the most part on the particular reactants and on whether or not a solvent is used. Solvents used will typically be hydrocarbon solvents such as xylene, but any non-polar, unreactive solvent can be used including benzene and toluene and/or mixtures thereof.

Molar ratios, less than molar ratios or more than molar ratios of the reactants can be used. For the aminoalcohol, preferentially a molar ratio of 1:1 to about 8:1 of epoxide to amine is chosen.

The times for the reactions are also not believed to be critical. The process is generally carried out in from about one to twenty-four hours or more.

In general, the reaction products of the present invention may be employed in any amount effective for imparting the desired degree of activity to improve the low temperature characteristics of distillate fuels. In many applications the products are effectively employed in amounts from about 0.001% to about 10% by weight and preferably from about 0.01% to about 5% of the total weight of the composition.

These additives may be used in conjunction with other known low-temperature fuel additives (dispersants, etc.) being used for their intended purpose.

The fuels contemplated are liquid hydrocarbon combustion fuels, including the distillate fuels and fuel oils. Accordingly, the fuel oils that may be improved in accordance with the present invention are hydrocarbon fractions having an initial boiling point of at least about 250° F. and an end-boiling point no higher than about 750° F. and boiling substantially continuously throughout their distillation range. Such fuel oils are generally known as distillate fuel oils. It is to be understood, however, that this term is not restricted to straight run distillate fractions. The distillate fuel oils can be straight run distillate fuel oils, catalytically or thermally cracked (including hydrocracked) distillate fuel oils, or mixtures of straight run distillate fuel oils, naphthas and the like, with cracked distillate stocks. Moreover, such fuel oils can be treated in accordance with well-known commercial methods, such as, acid or caustic treatment, hydrogenation, solvent refining, clay treatment, etc.

The distillate fuel oils are characterized by their relatively low viscosities, pour points, and the like. The principal property which characterizes the contemplated hydrocarbons, however, is the distillation range. As mentioned hereinbefore, this range will lie between about 250° F. and about 750° F. Obviously, the distillation range of each individual fuel oil will cover a narrower boiling range falling, nevertheless, within the above-specified limits. Likewise, each fuel oil will boil substantially continuously throughout its distillation range.

Contemplated among the fuel oils are Nos. 1, 2 and 3 fuel oils used in heating and as diesel fuel oils, and the jet combustion fuels. The domestic fuel oils generally conform to the specification set forth in A.S.T.M. Specifications D396-48T. Specifications for diesel fuels are defined in A.S.T.M. Specification D975-48T, Typical jet fuels are defined in Military Specification MIL-F-5624B.

The following examples are illustrative only and are not intended to limit the scope of the invention.

EXAMPLE 1

Preparation of Additive Entry 3

Di(hydrogenated tallow) amine (50.0 g, 0.10 mol; e.g. Armeen 2HT from Akzo Chemie), and 1,2-epoxyoctadecane (33.6 g, 0.125 mol; e.g. Vikolox 18 from Viking Chemical) were combined and heated at 160° C. for 17 hours. Trimesic acid (7.71 g, 0.037 mol; e.g. from Amoco Chemical Co.), and xylene (approx. 60 ml) were added and heated at reflux (180°-240° C.) with azeotropic removal of water for 8 hours. Volatiles were then removed from the reaction medium at 190°-200° C., and the reaction mixture was hot filtered to give the final product.

EXAMPLE 2

Preparation of Additive Entry 17

Di(hydrogenated tallow) amine (50.0 g, 0.10 mol; e.g. Armeen 2HT from Akzo Chemie), and 1,2-epoxyoctadecane (33.6 g, 0.125 mol; e.g. Vikolox 18 from Viking Chemical) were combined and heated at 160° C. for 17 hours. Norborene dicarboxylic anhydride (9.03 g, 0.055 mol; e.g. from Aldrich Chemical Co.), and xylene (approx. 60 ml) were added and heated at reflux (180°-250° C.) with azeotropic removal of water for 8 hours. Volatiles were then removed from the reaction medium at 190°-200° C., and the reaction mixture was hot filtered to give the final product.

EXAMPLE 3

Preparation of Additive Entry 22

Di(hydrogenated tallow) amine (50.0 g, 0.10 mol; e.g. Armeen 2HT from Akzo Chemie), and 1,2-epoxyoctadecane (33.6 g, 0.125 mol; e.g. Vikolox 18 from Viking Chemical) were combined and heated at 190° C. for 19 hours. Maleic anhydride (5.88 g, 0.060 mol; e.g. from Aldrich Chemical Co.), and xylene (approx. 60 ml) were added and heated at reflux (185°-190° C.) with azeotropic removal of water for 22 hours. Volatiles were then removed from the reaction medium at 190° C., and the reaction mixture was hot filtered to give 81.1 g of the final product.

EXAMPLE 4

Preparation of Additive Entry 29

Di(hydrogenated tallow) amine (50.0 g, 0.10 mol; e.g. Armeen 2HT from Akzo Chemie), and 1,2-epoxyoctadecane (33.6 g, 0.125 mol; e.g. Vikolox 18 from Viking Chemical) were combined and heated at 170° C. for 22 hours. Benzophenone tetracarboxylic dianhydride (17.7 g, 0.055 mol; e.g. BTDA from Allco Chemical Corp.), and xylene (approx. 60 ml) were added and heated at reflux (185°-190° C.) with azeotropic removal of water for 4.5 hours. Jeffamine M-600 (31.5 g, 0.0525 mol; e.g. a mono-capped amine-terminated polypropylene oxide, from Akzo Chemie) was added and heated at 180° C. for 19 hr with azeotropic removal of water. Volatiles were then removed from the reaction medium at 180° C., and the reaction mixture was hot filtered to give 112.7 g of the final product.

PREPARATION OF ADDITIVE CONCENTRATE

A concentrate solution of 100 ml total volume was prepared by dissolving 10 g of additive in mixed xylenes solvent. Any insoluble particulates in the additive concentrate were removed by filtration before use.

TEST FUELS

Two test fuels were used for the screening of additive activity:

| | |
|---|---|
| FUEL A: | |
| API Gravity | 34.1 |
| Cloud Point (°F.) | 23.4 |
| CFPP (°F.) | 16 |
| Pour Point (°F.) | 0 |
| Distillation (°F.; D 86) | |
| IBP | 319 |
| 10% | 414 |
| 50% | 514 |
| 90% | 628 |
| FBP | 689 |
| FUEL B: | |
| API Gravity | 31.5 |
| Cloud Point (°F.) | 21.4 |
| CFPP (°F.) | 14 |
| Pour Point (°F.) | 10 |
| Distillation (°F.; D 86) | |
| IBP | 340 |
| 10% | 439 |
| 50% | 534 |
| 90% | 640 |
| FBP | 693 |

Test Procedures

The cloud point of the additized distillate fuel was determined using an automatic cloud point test based on the commercially available Herzog cloud point tester;

test cooling rate is approximately 1° C./min. Results of this test protocol correlate well with ASTM D2500 methods. The test designation (below) is "HERZOG."

The low-temperature filterability was determined using the Cold Filter Plugging Point (CFPP) test. This test procedure is described in "Journal of the Institute of Petroleum," Volume 52, Number 510, Jun. 1966, pp. 173–185.

Test results may be found in Tables 1–3 below. The products of this invention represent a significant new generation of wax crystal modifier additives which are dramatically more effective than many previously known additives. They represent a viable alternative to the use of kerosene in improving diesel fuel low-temperature performance.

TABLE 1

Core/Pendant Group Structures
Category A: Aromatic, Heterocyclic Cores

| Entry | Pendant Group(s) | Core | Mole Ratio | Performance Improvement (F): Cloud Point (HERZOG) | CFPP |
|---|---|---|---|---|---|
| | Fuel A; 1000 ppm Additive | | | | |
| 1 | Armeen 2HT/ Vikolox 18 | | 1/1.25 | 2.2 | −2 |
| 2 | Armeen 2HT | PMDA | 4/1 | 2.5 | 0 |
| 3 | Armeen 2HT/ Vikolox 18 | Trimesic Acid | 3/3.75/ 1.1 | 5.2 | 2 |
| 4 | Armeen 2HT/ Vikolox 18 | Trimesic Acid | 3/2/1 | 4.7 | 2 |
| 5 | Armeen 2HT/ Vikolox 18 | Trimesic Acid | 2/2/1 | 4.7 | 2 |
| 6 | Armeen 2HT/ Vikolox 18 | Trimesic Acid | 2/1/1 | 4.5 | 6 |
| 7 | Armeen 2HT/ Vikolox 18 | Phthalic Anhy | 2/2.5/ 1.1 | 5.6 | 0 |
| 8 | Armeen 2HT/ Vikolox 18 | Isophthalic Acid | 2/2.5/1 | 3.4 | 2 |
| 9 | Armeen 2HT/ Vikolox 18 | Terephthalic Acid | 2/2.5/1 | 3.1 | 0 |
| 10 | Armeen 2HT/ Vikolox 18 | 2,6-Naphthalene Dicarboxylic Acid | 2/2.5/1 | 2.4 | −2 |
| 11 | Armeen 2HT/ Vikolox 18 | Tetrahydrofuran Tetracarboxylic Dianhydride | 2/2.5/ 1.1 | 6.9 | 7 |
| | Fuel B; 1000 ppm Additive | | | | |
| 12 | Armeen 2HT | PMDA | 2/1.1 | 2.2 | 0 |
| 13 | Armeen 2HT | BTDA | 2/1.1 | 1.3 | −2 |
| | Fuel B; 500 ppm Additive | | | | |
| 14 | Armeen 2HT/ Vikolox 18 | Trimellitic Anhy | 3/3/1 | 3.6 | 4 |
| 15 | Armeen 2HT/ Vikolox 18 | Trimellitic Anhy | 2/2/1 | 3.3 | 2 |
| 16 | Armeen 2HT/ Vikolox 14–20 | Trimellitic Anhy | 3/3/1 | 3.6 | 4 |

TABLE 2

Core/Pendant Group Structures
Categories B, C, (See below)

| Entry | Pendant Group(s) | Core | Mole Ratio | Performance Improvement (F): Cloud Point (HERZOG) | CFPP |
|---|---|---|---|---|---|
| | Category B; "Bicyclic & Alicyclic Cores" Fuel A; 1000 ppm Additive | | | | |
| 17 | Armeen 2HT/ Vikolox 18 | Norbornene Dicarboxylic Anhydride | 2/2.5/ 1.1 | 6.5 | 6 |
| 18 | Armeen 2HT/ Vikolox 18 | Bicyclooctene Tetracarboxylic Dianhydride | 4/5/1.1 | 6.3 | 5 |
| 19 | Armeen 2HT/ Vikolox 18 | Camphoric Acid | 2/2.5/ 1/1 | 3.4 | 2 |
| 20 | Armeen 2HT/ Vikolox 18 | Cyclohexane Dicarboxylic Anhydride | 2/2.5/ 1.1 | 5.4 | 4 |
| | Category C; "Alkyl Core" Fuel A; 1000 ppm Additive | | | | |
| 21 | Armeen 2HT/ Vikolox 18 | Butyl Citrate | 3/4/3.3 | 4.5 | 6 |
| 22 | Armeen 2HT/ Vikolox 18 | Maleic Anhydride | 2/2.5/ 1.2 | 9 | 7 |
| 23 | Armeen 2HT/ Vikolox 18 | Hystrene 3695 | 1.05/ 1.3/1 | 1.3 | 2 |
| 24 | Armeen 2HT/ Vikolox 18 | Hystrene 5460 | 2.6/ 3.25/1 | 2.4 | 4 |

TABLE 3

Post-Reacted Core/Pendant Group Structures
Category D: Multifunctional Cores

| Entry | Pendant Group(s) | Core/ Post Reactant | Mole Ratio | Performance Improvement (F): Cloud Point (HERZOG) | CFPP |
|---|---|---|---|---|---|
| | Fuel A; 1000 ppm Additive | | | | |
| 25 | Armeen 2HT/ Vikolox 18 | PMDA/ UCON LB-1145 | 2/2.5/ 1.1/ 1.05 | 5.2 | 2 |
| 26 | Armeen 2HT/ Viklox 18 | BTDA/ UCON LB-1145 | 2/2.5/ 1.1/ 1.05 | 4.9 | 2 |
| 27 | Armeen 2HT/ Viklox 18 | PMDA/ Jeffamine M-600 | 2/2.5/ 1.1/ 1.05 | 6.7 | 6 |
| 28 | Armeen 2HT/ Viklox 18 | BTDA/ Jeffamine M-600 | 2/2.5/ 1.1/ 1.05 | 6.8 | 11 |
| 29 | Armeen 2HT/ Viklox 18 | PMDA/ Surfonamine MNPA-380 | 2/2.5/ 1.1/ 1.05 | 8.2 | 4 |
| 30 | Armeen 2HT/ Viklox 18 | BTDA/ Surfonamine MNPA-380 | 2/2.5/ 1.1/ 1.05 | 8.0 | 6 |

TABLE 3-continued

| Post-Reacted Core/Pendant Group Structures Category D: Multifunctional Cores | | | | | |
|---|---|---|---|---|---|
| | | | | Performance Improvement (F): | |
| Entry | Pendant Group(s) | Core/ Post Reactant | Mole Ratio | Cloud Point (HERZOG) | CFPP |
| 31 | Jeffamine M-600 | PMDA | 1/1 | 0.7 | −2 |
| 32 | Jeffamine M-600 | BTDA | 1/1 | 0 | 4 |
| 33 | Armeen 2HT/ Viklox 18 | BTDA/ E-100 | 2/2.5/ 1.1/.5 | 6.5 | 11 |
| 34 | Armeen 2HT/ Viklox 18 | PMDA/ E-100 | 2/2.5/ 1.1/.5 | 7.4 | 11 |
| 35 | Armeen 2HT/ Viklox 18 | Maleic ANHY/ TEPA | 2/2.5/ 1.2/0.5 | 6.8 | 4 |
| 36 | Armeen 2HT/ Viklox 18 | Maleic ANHY/ TEPA | 2/2.5/ 1.2/0.3 | 7.4 | 6 |

We claim:

1. A product of the reaction of a hydrocarbyl carboxylic anhydride-containing or carboxylic acid-containing group having three reactive carboxylic groups with another group selected from the combination of an aminoalcohol or mixture of aminoalcohols and a secondary amine said reactants being reacted in substantially molar, less than molar or more than molar amounts at temperatures varying from about 85° to about 250° C. under pressures varying from about ambient or autogenous to slightly higher for a time sufficient to obtain the desired ester/amide additive product of reaction.

2. The product of claim 1 wherein the aminoalcohol is derived from an epoxide and a secondary amine in the manner described below:

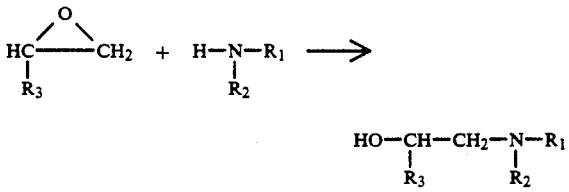

Where:

$R_1$, $R_3$=$C_8$–$C_{50}$ linear hydrocarbyl groups, either saturated or unsaturated $R_2$=$R_1$, or $C_1$–$C_{100}$ hydrocarbyl.

3. The product of claim 1 wherein hydrocarbyl is selected from the group consisting of aromatic, alicyclic, aralkyl, alkylaryl and alkyl containing from one to about one hundred carbon atoms and corresponding heteroatom-containing analogues.

4. The product of claim 3 wherein the hydrocarbyl group is aromatic and derived from trimesic acid or anhydride thereof and trimellitic acid or anhydride thereof.

5. The product of claim 3 wherein the hydrocarbyl group is derived from trimesic acid.

6. The product of claim 3 wherein the hydrocarbyl group is derived from trimellitic anhydride.

7. The product of claim 3 wherein the hydrocarbyl group is alkyl derived from trimer acids.

8. The product of claim 2 wherein the amine is selected from the group consisting of ditallow amine, di(hydrogenated tallow) amine, dioctadecylamine, methyloctadecylamine or mixtures thereof.

9. The product of claim 8 wherein the amine is di(hydrogenated tallow) amine.

10. The product of claim 2 wherein the epoxide is a $C_{18}$ linear 1,2-epoxyalkane.

11. A fuel composition comprising a major proportion of a liquid hydrocarbon fuel and a minor low temperature improving amount of the reaction product of a hydrocarbyl carboxylic anhydride-containing or carboxylic acid-containing group having three reactive carboxylic groups with another group selected from the combination of an aminoalcohol or mixture of aminoalcohols and a secondary amine said reactants being reacted in substantially molar, less than molar or more than molar amounts at temperatures varying from about 85° to about 250° C. or reflux under pressures varying from about ambient or autogenous to slightly higher for a time sufficient to obtain the desired ester/amide additive product of reaction.

12. The fuel composition of claim 11 comprising from about 0.001% to about 10% by weight of the total composition of said additive reaction product.

13. The fuel composition of claim 11 wherein the aminoalcohol is derived from an epoxide and a secondary amine in the manner described below:

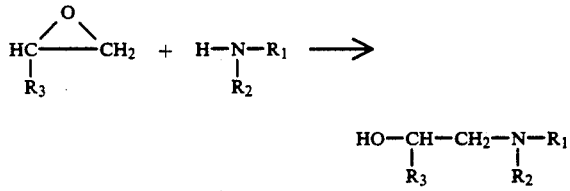

Where:

$R_1$, $R_3$=$C_8$–$C_{50}$ linear hydrocarbyl groups, either saturated or unsaturated.

$R_2$=$R_1$, or $C_1$–$C_{100}$ hydrocarbyl.

14. The fuel composition of claim 11 wherein hydrocarbyl is selected from the group consisting of aromatic, alicyclic, aralkyl, alkylaryl and alkyl containing from one to about one hundred carbon atoms and corresponding heteroatom-containing analogues.

15. The fuel composition of claim 14 wherein hydrocarbyl is aromatic and derived from trimesic acid or anhydride thereof and trimellitic acid or anhydride thereof.

16. The composition of claim 14 wherein the hydrocarbyl group is derived from trimesic acid.

17. The composition of claim 14 wherein the hydrocarbyl group is derived from trimellitic anhydride.

18. The composition of claim 14 wherein the hydrocarbyl group is alkyl derived from trimer acids.

19. The composition of claim 11 wherein the amine is selected from the group consisting of ditallow amine, di(hydrogenated tallow) amine, dioctadecylamine, methyloctadecylamine or mixtures thereof.

20. The fuel composition of claim 19 wherein the amine is di(hydrogenated tallow) amine.

21. The composition of claim 11 wherein the fuel is a liquid hydrocarbon combustion fuel selected from the group consisting of distillate fuels and fuel oils.

22. The composition of claim 21 wherein the fuel oil is selected from fuel oil numbers 1, 2 and 3 and diesel fuel oils and jet combustion fuels.

23. The composition of claim 22 wherein the fuel is a diesel fuel.

24. An additive concentrate comprising at least one inert liquid hydrocarbon solvent or mixture of solvent having dissolved therein an additive product of reaction produced by the reaction of a hydrocarbyl carboxylic anhydride-containing or carboxylic acid-containing group having three reactive carboxylic groups with another group selected from the combination of an aminoalcohol or mixture of aminoalcohols and a secondary amine said reactants being reacted in substantially molar, less than molar or more than molar amounts at temperatures varying from about 85° to about 250° C. under pressures varying from about ambient or autogenous to slightly higher for a time sufficient to obtain the desired ester/amide additive product of reaction.

25. The additive concentrate of claim 24 comprising a solution wherein each 100 ml of volume contains dissolved therein 10 grams of said additive.

26. The additive concentrate of claim 25 wherein said solvent is mixed xylenes.

27. A process of reaction comprising the reaction of a hydrocarbyl carboxylic anhydrides-containing or carboxylic acid-containing group having three reactive carboxylic groups with another group selected from the combination of an aminoalcohol or mixture of aminoalcohols and a secondary amine said reactants being reacted insubstantialy molar, less than molar or more than molar amounts at temperatures varying from about 85° to about 250° C. under pressures varying from about ambient or autogenous to slightly higher for a time sufficient to obtain the desired ester/amide additive product of reaction.

28. The process of claim 27 wherein hydrocarbyl is selected from the group consisting of aromatic, alicyclic, aralkyl, alkylaryl and alkyl containing from one to about one hundred carbon atoms and corresponding heteroatom-containing analogues.

29. The process of claim 28 wherein the hydrocarbyl group is aromatic and derived from trimesic acid or anhydride thereof and trimellitic acid or anhydride thereof.

30. The process of claim 29 wherein the hydrocarbyl group is alkyl derived from trimer acids.

31. The process of claim 27 wherein the amine is selected from the group consisting of ditallow amine, di(hydrogenated tallow) amine, dioctadecylamine, methyloctadecylamine or mixtures thereof.

32. The process of claim 31 wherein the amine is di(hydrogenated tallow) amine.

33. The process of claim 27 wherein the epoxide is a $C_{18}$ linear 1,2-epoxyalkane.

34. A fuel composition as described in claim 11 wherein the final desired additive product of reaction therein is further reacted with a reactant selected from the group consisting of polypropylene glycol, aminopolyethers and polyethyleneamine is substantially molar, less than molar and more than molar ratios, at temperatures varying from 85° C. to about 250° C. or reflux ambient or autogenous pressures.

* * * * *

UNITED STATES PATENT AND TRADEMARK OFFICE

CERTIFICATE OF CORRECTION

PATENT NO. : 5,284,493

DATED : February 8, 1994

INVENTOR(S) : Baillargeon et al.

It is certified that error appears in the above-identified patent and that said Letters Patent is hereby corrected as shown below:

Column 11, Line 29, delete "insubstantialy" and insert -- in substantially --

Column 12, Line 30, before "ambient" insert --under--

Signed and Sealed this

Twenty-eighth Day of June, 1994

*Attest:*

Bruce Lehman

BRUCE LEHMAN

*Attesting Officer*

*Commissioner of Patents and Trademarks*